US005833497A

United States Patent [19]

Byfield, Jr.

[11] Patent Number: 5,833,497

[45] Date of Patent: Nov. 10, 1998

[54] ELECTRICAL CONNECTOR FOR TAPPING INTO A FUSE BLOCK

[76] Inventor: Dwight Byfield, Jr., 5082 W. Indianapolis, Fresno, Calif. 93722

[21] Appl. No.: 791,727

[22] Filed: Jan. 29, 1997

[51] Int. Cl.[6] ..... H01R 33/95

[52] U.S. Cl. ..... 439/622

[58] Field of Search ..... 439/620, 621, 439/622

[56] References Cited

U.S. PATENT DOCUMENTS 4,097,109 6/1978 Cross .
4,372,638 2/1983 Sohler .

*Primary Examiner*—Khiem Nguyen
*Assistant Examiner*—Eugene G. Byrd
*Attorney, Agent, or Firm*—Roger W. Jensen

[57] ABSTRACT

An electrical connector for use with a fuse holding block and a fuse body having conductive contact blades. The electrical connector is an elongated conductive thin member having a shoulder adjacent a first end, an integral tab positioned between the shoulder and the other end, the tab extending at an angle, and a fuse blade contact portion extending from the other end. The thin member is removably attachable to the fuse body with (i) the fuse blade contact portion being in abutting contact with a fuse blade, (ii) an end of the tab being positioned in a channel of the fuse body and abutting a shoulder means of the channel, and (iii) the shoulder of the thin member abutting a top surface of the fuse body head portion.

10 Claims, 4 Drawing Sheets

FIG. 13
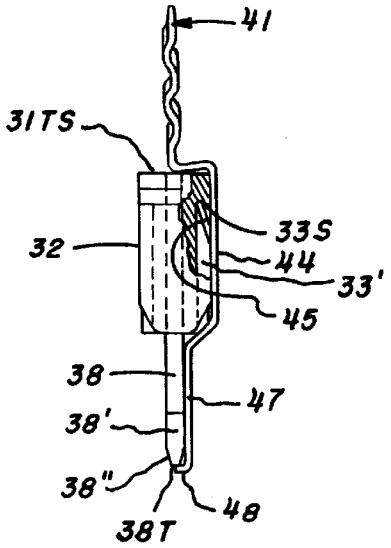
FIG. 12
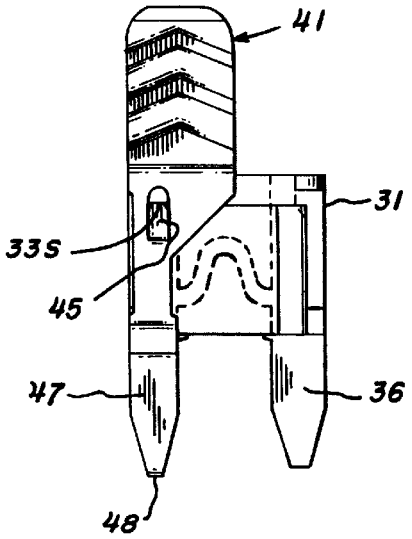
FIG. 14
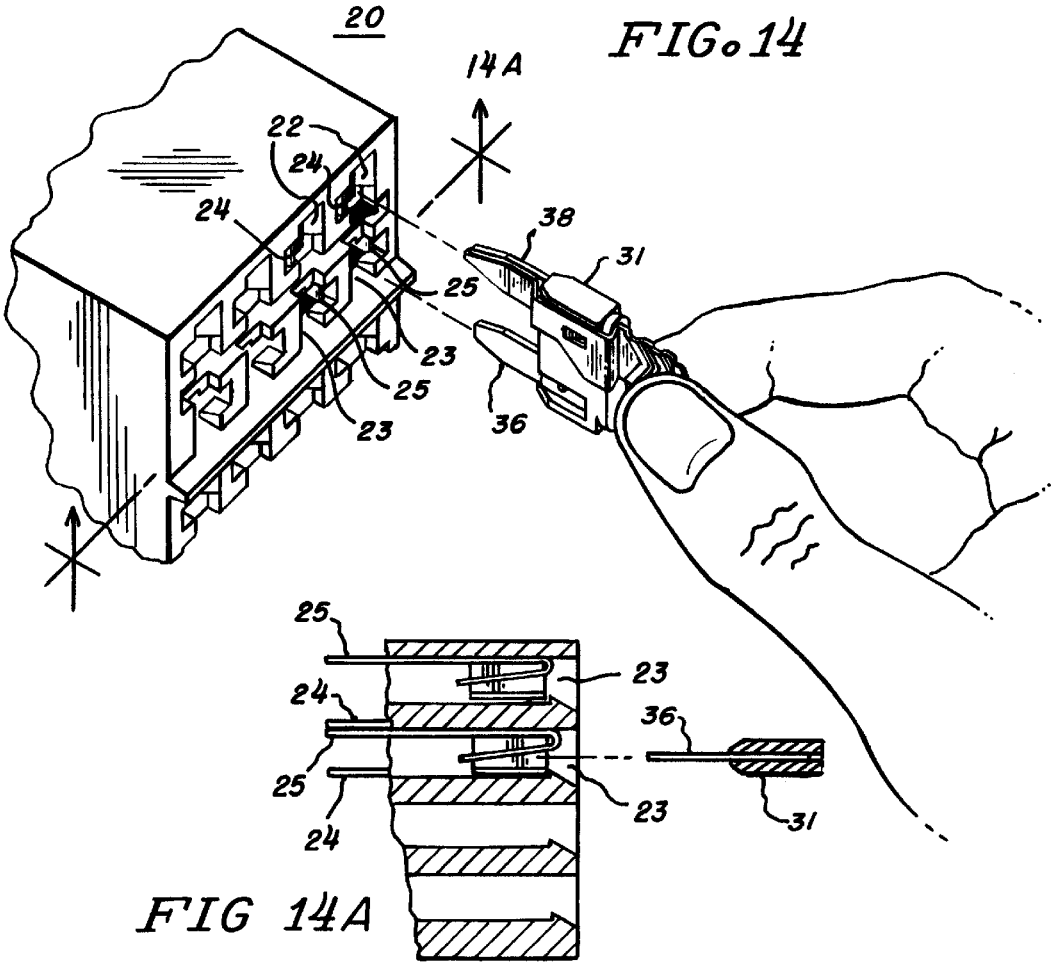
FIG 14A

ELECTRICAL CONNECTOR FOR TAPPING INTO A FUSE BLOCK

FIELD OF THE INVENTION

This invention relates to the field of special electrical connectors which may be used to tap into a fuse block used in automobiles, trucks, aircrafts and the like.

Some years ago, the fuse blocks of most motor vehicles contained spaced pairs of conductive spring clips between which the metalized ends of hollow glass cylindrical cartridge fuses were inserted. This prior art type of fuse and fuse block was largely superseded by flat fuses such as shown in prior U.S. Pat. No. 4,097,109. The flat fuse technology has yielded even smaller and smaller fuse bodies; see, for example, prior U.S. Pat. No. 4,372,638.

When the motor vehicle is manufactured, it is customary that the fuse block will contain a plurality of fuses (frequently of different current ratings) so as to protect a corresponding plurality of circuits in the motor vehicle.

However, it is very common in the so-called "after market" for the operator of the motor vehicle to desire adding additional electrical equipment above and beyond that which was included in the vehicle at the time of original manufacture. Examples of such equipment are numerous, e.g., auxiliary lights, radios, stereos, CD players, etc. It is desirable to have a means for tapping into the fuse block to obtain power for such additional added equipment and there are various prior art tapping arrangements both for the hollow glass type cylindrical fuse as well as the subsequent flat fuses. It is, of course, also possible to consider adding additional wires or leads directly to the battery power supply of the vehicle.

One of the prior art arrangements for tapping into a fuse block having a flat fuse is shown in FIGS. 7, 7A and 8 of this specification. That prior art device included a thin metal member that hooked around the end of the contact blade of the flat fuse. While that arrangement would suffice for some applications, it is not satisfactory for many other applications; the problem being that the double thickness of metal wrapped around the end of the contact blade adds too much total thickness with respect to the capability of the coacting female connector in the fuse block, i.e., the female connector would be excessively spread apart and damaged.

SUMMARY OF THE INVENTION

The present invention overcomes the disadvantage of the above-described prior art arrangement shown in FIGS. 7–8 herein. The present invention provides a unique connector fashioned out of a thin strip of metal and is intended for use in combination with a fuse holding block or fuse block having at least one pair of recesses with fuse blade contact means positioned in each of said recesses including means for resiliently contacting a fuse contact blade. The unique electrical connector is also intended for use with a fuse body having a pair of longitudinally extending electrically conductive contacting blades. The fuse body is adapted to be removably connected to the fuse block with the pair of contact blades being respectively and resiliently held in electrical contact with the fuse blade contact means of the block. The fuse body has a head portion having a top surface and opposed flat side surfaces and at least one of said side surfaces has a longitudinally extending channel substantially aligned with one of the contact blades. A shoulder means is defined at the end of the channel adjacent to the top surface.

More specifically, my unique electrical connector comprises an elongated electrically conductive thin member having first and second or other ends. The first end is configured to provide male connector means adapted to connect with female connector means. The thin member further comprises a shoulder adjacent the first end and an integral tab positioned between said shoulder and the other end, the tab extending at an angle to the thin member and having an end.

The unique connector further includes a fuse blade contact portion extending from the other end toward the first end. The afore described thin member is adapted to be removably attached to a fuse body (i) said fuse blade contact portion being in abutting contact with one of said blades of said fuse body, (ii) said end of said tab being positioned in said channel of said fuse body and abutting said shoulder means of said channel, and (iii) said shoulder of said thin member abutting said top surface of said fuse body head portion.

Thus, the elongated thin member may be removably attached to the fuse body and contact blade thereof so as to form a subassembly. Thereafter the subassembly may be inserted into the fuse holding block; more specifically, the subassembly may be inserted into the pair of recesses with said fuse contact blade and abutted fuse contact blade portion of the thin member being resiliently held in electrical contact with said fuse block fuse blade contact means.

In the preferred embodiment of the invention, the thin member further includes, at said other end thereof, an integral hook-like extension having a preselected length so that, when said thin member is assembled with the fuse body and contact blade, the extension overlies the end of the contact blade.

DESCRIPTION OF THE DRAWINGS

FIG. 12 shows a plan view of a flat fuse to which is attached my unique connector and FIG. 13 is a side view of the subassembly shown in FIG. 12 with some of the fuse block removed so as to show the end of the tab abutted against the shoulder of the channel and with the shoulder of the thin member abutted against the top of the head portion of the fuse body.

FIG. 14 shows an isometric view of the subassembly of a fuse body and the connector being manually inserted into a pair of recesses of a fuse holding block. FIG. 14A is a cross-section of the fuse block as viewed along section lines 14A—14A of FIG. 14.

DETAILED DESCRIPTION OF THE INVENTION

The unique electrical connector of this invention is intended for use with a fuse holding block of which numerous and somewhat different configurations are currently being used in this industry. A representative fuse holding block 20 is shown in FIG. 14 having at least one pair of recesses 22 and 23 with fuse blade contact means 24 and 25 respectfully positioned in each of the recesses. The fuse blade contact means is depicted in more detail in FIG. 14A and, as is well understood by those skilled in the art, is merely one of many configurations used in the industry. The fuse blade contact means is characterized by having means for resiliently engaging and contacting a fuse body contact blade. Thus there is a spring-like or resilient action or function in the fuse blade contact means so as to snuggly receive a fuse contact blade. It should be understood, however, that the fuse blade contact means typically has only a limited amount of ability for being spread apart by the fuse contact blade; excessive spreading apart may pemanently spring apart the fuse blade contact means.

Figure 1:
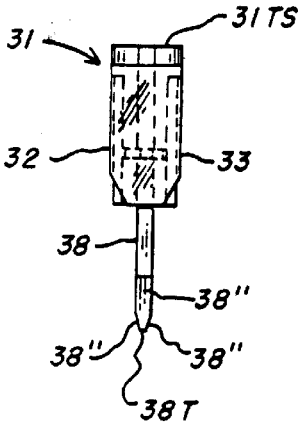
FIG. 1 is a side view of a flat-type fuse body with which the present invention may be used.
Figure 2:
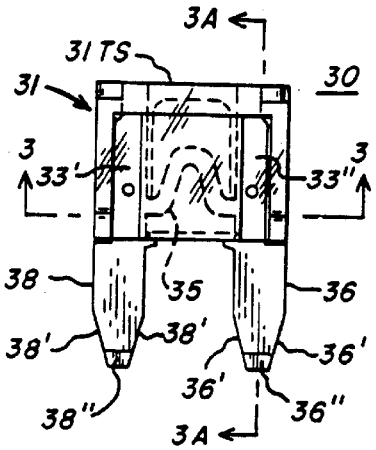
FIG. 2 is a plan view of the fuse shown in FIG. 1.
Figure 3:
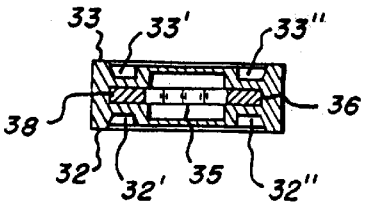
FIG. 3 is a cross-sectional view of the fuse as viewed along section lines 3—3 of FIG. 2.
Figure 3A:
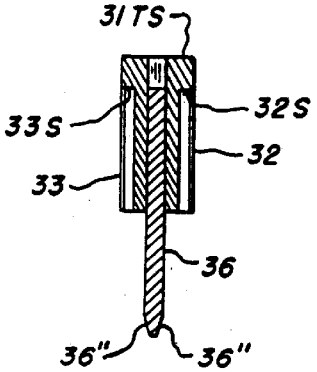
FIG. 3A is a cross-sectional view of the fuse as viewed along section lines 3A—3A of FIG. 2.

Referring to FIGS. 1, 2 and 3, a fuse body 30 is depicted and, as shown, is very similar in shape and characteristics to fuses sold by the Cooper-Bussman Company and Little Fuse Inc., but is shown approximately three times larger than actual size. Fuse body 30 has a head portion 31 with a top surface 31TS and a pair of flat side surfaces 32 and 33. As manufactured, the fuse body 30 has a pair of channels in each of the side surfaces, more specifically sides 32 and 33 have respectively channels 32', 32" and 33', 33" as is clearly shown in FIG. 3. Referring to FIG. 3A, at the ends of the channels, adjacent to the top surface 31TS, are shoulders 32S and 33S for sides 32 and 33 respectively of the head 31.

A metallic fuse means 35 (see FIG. 2) integral with a pair of metallic contact blades 36 and 38 is encapsulated by the head 31 which, as is well understood by those skilled in the art, is fashioned out of a suitable plastic insulative material. The contact blades 36 and 38 extend longitudinally parallel to one another and spaced apart as is shown in FIG. 2. The blades 36 and 38 are tapered at their extremities as identified by reference numerals 36', 36" and 38', 38" respectively (see FIGS. 1, 2 and 3A).

It will be noted from FIG. 2 that the channels 33' and 33" extend longitudinally and are respectively substantially aligned with the contact blades 38 and 36.

Figure 6:
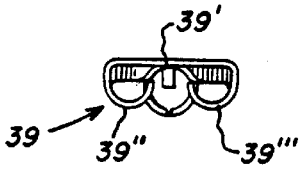
PRIOR ART FIG. 6
FIGS. 4, 5 and 6 are respectively side, plan and end views of a female connector means which may be used to coact with the male connector means of my unique connector.
Figure 4:
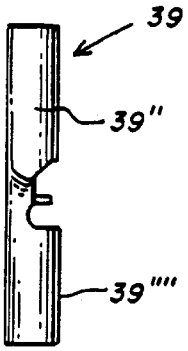
PRIOR ART FIG. 4
Figure 5:
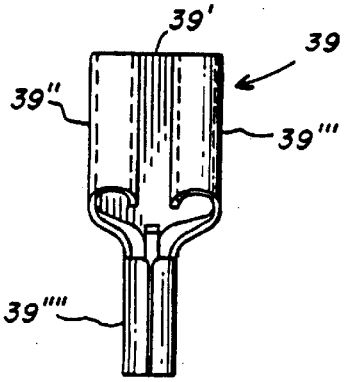

The representative prior art female connector means shown in FIGS. 4–6 is identified by reference numeral 39. As depicted this female connector means comprises a unitary metallic member having a flat portion 39' with a pair of side portions 39" and 39'" curved around inwardly so that the ends thereof are spaced from the aforesaid flat surface 39'. Finally the connector means 39 includes a shank portion 39"" for attaching the connector to a wire or conductor, not shown.

Figure 7:
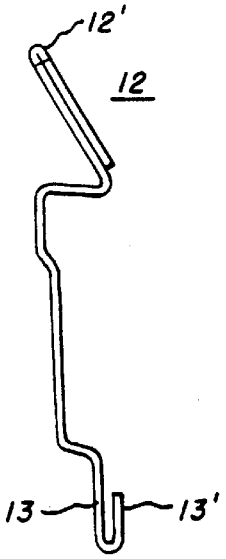
PRIOR ART FIG. 7
FIG. 7 is a side view of a prior art tap for use with a flat fuse body and FIGS. 7A and 8 are respectively side and plan views of the tap of FIG. 7 shown as assembled with a flat type fuse, FIG. 8 being the view as seen along section lines 8—8 of FIG. 7A.
Figure 7A:
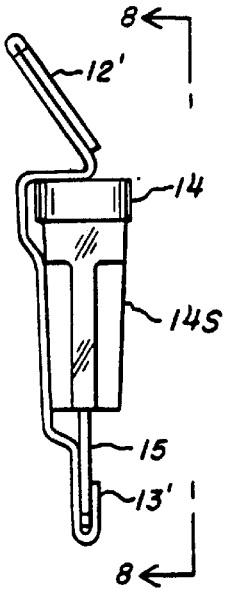
Figure 8:
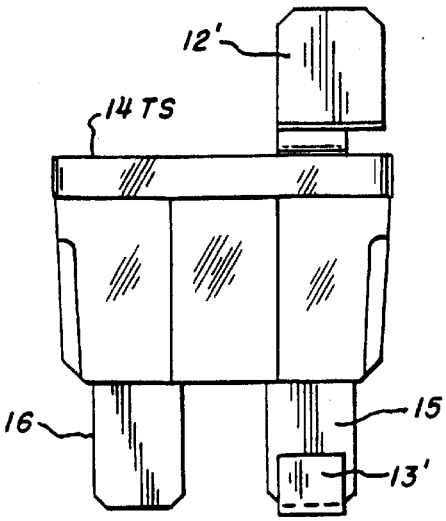
Figure 11:
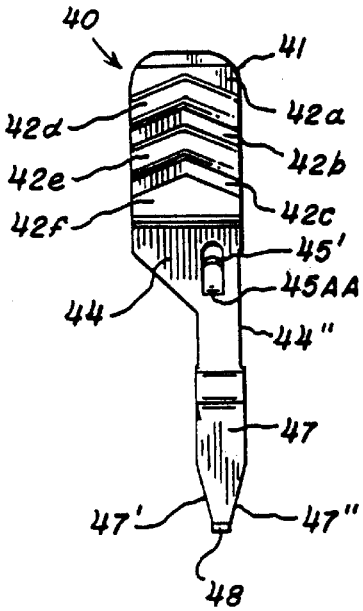
FIGS. 9, 10 and 11 are respectively side, top and bottom views of my unique connector.

The prior art tap is shown in FIG. 7 comprising a connector identified by reference numeral 12 having a first end 12' constituting a male connector means adapted for connection with a female connector means, not shown. The other end of connector 12 has a U-shape 13–13' which is adapted to engage both sides of a flat contact blade 15 of a flat fuse 14 having a top 14TS and a side 14S, the other contact blade being identified by reference numeral 16. As indicated above, a significant problem with this type of tap is the excessive springing or stressing and damaging of the fuse blade contact means.

Figure 15:
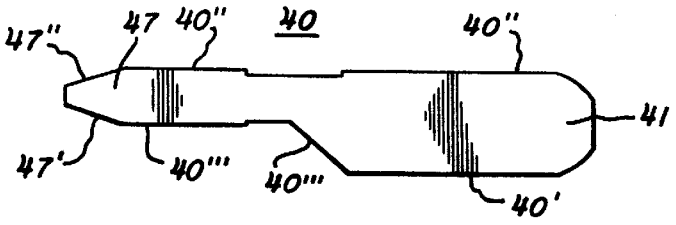
FIGS. 15 and 16 show respectively the plan and side views of the thin member prior to the thin member being bent into the configuration shown in FIGS. 9–11, 12 and 13.

Referring especially to FIGS. 9–11 and 15, my unique connector is identified by reference numeral 40 comprising an elongated electrically conductive thin member preferably stamped out of hardened brass and having a first end 41, the sides of which are identified by reference numerals 40' and 40" (see FIG. 15). This end of the connector functions as a means for connection with another electrical connector; more specifically, in the preferred embodiment end 41 of member 40 serves as a male connector means adapted to connect with a female connector means such as the female connector shown in FIGS. 4–6.

The male connector means 41 is shown to have a chevron-like appearance identified by reference numerals 42A–F (see FIG. 11); this arrangement gives the end 41 more thickness or body and it is the subject matter of a separate patent application of the applicant filed concurrently with the filing of this application, Ser. No. 08/790,646, filed Jan. 29, 1997. It should be understood that the male connector means may be smooth-faced, i.e., without the chevrons 42A–F.

Referring to FIG. 15, it is seen that the side 40" extends substantially from the first end 41 to the other end of the thin member 40. The other side 40' extends approximately half way toward the other end and then is reduced to a significantly smaller dimension defined by side 40'", a sloped portion 40'" being connected between 40' and 40"". The portion of member 40 lying between surfaces 40" and 40"" is identified by reference numeral 47 which, at the end thereof, is tapered as defined by surfaces 47' and 47".

Referring again to FIG. 9, a shoulder 43 is provided adjacent the first end 41 comprising a first 90 degree bend in the material 43' followed by a second 90 degree bend 43", the following section of the material being identified in FIG. 9 by reference numeral 44.

Figure 9:
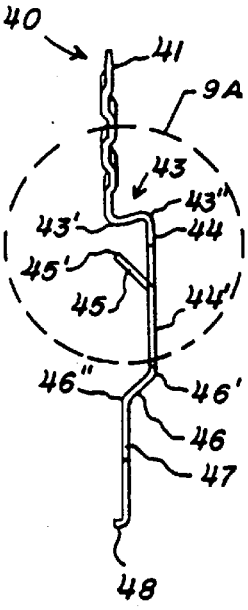
Figure 10:
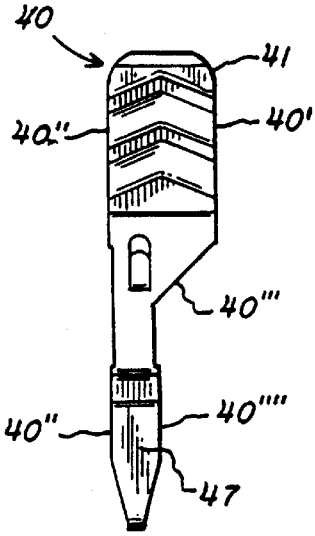

The thin member further includes a tab 45 positioned between the shoulder 43 and the other end of the thin member. As shown in FIG. 9 the tab 45 extends at an angle to the surface 44 and has an end 45'.

A second shoulder-like means 46 is provided between the tab 45 and the other end of the thin member comprising a first bend 46' and a second bend 46", these bends being selected so that the afore described portion 47 of the thin member lies substantially in the same plane defined by the first end 41. An integral hook-like extension 48 is provided at the tip of the other end of the thin member as is shown in FIG. 9.

The thin member 40 is adapted to be removably attached to the fuse body as is clearly shown in FIGS. 12–14. It will be observed that the fuse blade contact portion 47 of the thin member is in abutting contact with the side of blade 38 (see FIG. 13); the end 45' of tab 45 is positioned in channel 33' of the fuse body and is abutting against the shoulder means 33S of that channel; and the shoulder 43 (more specifically first bend 43' thereof) is abutting the top surface 31TS of the fuse body 31.

It will be noticed from FIG. 9 that the bends 43' and 43" of shoulder 43 are shaped to permit some longitudinal movement of the end 41 with respect to the remaining portion of the thin member.

Figure 9A:
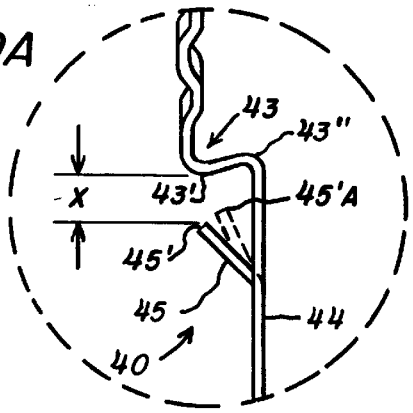
FIG. 9A is an enlargement of a portion of the thin member as depicted in FIG. 9.

In FIG. 9A (the enlargement of a portion of FIG. 9) the distance between the end 45' of tab 45 and the underside of first bend 43' is shown to be a dimension X and this distance is sufficient to permit the afore described assembly of the thin member 40 with the fuse block, i.e., to permit the end 45' to be inserted into the channel 33'. In the preferred embodiment, when the end 45' of tab 45 first encounters the shoulder 33S, the portion 44 of the member 40 is spaced slightly away from the side 33 of the fuse body. Then a squeezing action by the operator forcing portion 44 against the fuse body will result in a bending of the tab from the solid line position as shown in FIG. 9A to the dotted line portion 45'A as shown in FIG. 9A (which corresponds to the position of tab 45 as shown in FIG. 13). As the tab 45 is bent to the new position simultaneously the shoulder 43 is articulated so that the first bend 43' is moved upwardly as shown in FIG. 9A to a new position 43'A, the resiliency of the material thus providing a spring-like or clamping action holding the thin member 40 firmly to the body to permit the operator to hold the subassembly by the male connector end 41 as is depicted in FIG. 14.

Thus the thin member 40 may be removably attached to the fuse body and contact blade thereof to comprise a subassembly and thereafter inserted into one of the recesses of the fuse holding block as shown in FIG. 14 with said fuse contact blade and abutted fuse contact portion of the thin member 40 being resiliently held in electrical contact with the fuse blade contact means.

FIG. 15 shows the plan view of the thin member 40 prior to the formation of the tab 45 and the male connector means 42*a*–42*f*.

Figure 16:
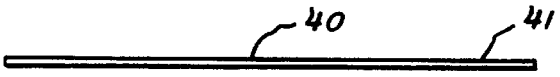
Figure 17:
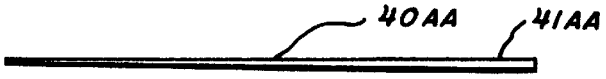
FIGS. 17 and 18 show respectively alternate side views of the thin member.

FIG. 16 shows a side view of the thin member prior to bending, FIG. 17 shows the thin member being tapered from right to left with the right ends 41AA being thicker than the other end. This would be accomplished by utilizing stock material that was correspondingly tapered.

Figure 18:
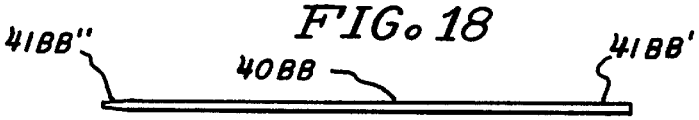

FIG. 18 shows a variation which may be used wherein the thin member 40BB is of constant thickness starting at the right end 41BB' except for the extreme left end 41BB" thereof which is tapered to facilitate the entrance of the subassembly into the recess of the fuse block.

The embodiments of an invention in which an exclusive property or right is claimed are defined as follows:

1. An electrical connector for use with (1) a fuse holding block having at least one pair of recesses, fuse blade contact means positioned in each of said recesses including means for resiliently contacting a fuse contact blade, and (2) a fuse body having a pair of longitudinally extending electrically conductive contact blades adapted to be removably connected to said fuse block with said blades being respectively and resiliently held in electrical contact with said fuse blade contact means, said fuse body being further characterized by having a head portion with a top surface and opposed flat side surfaces at least one of said surfaces having a longitudinally extending channel substantially aligned with one of said contact blades, a shoulder means being defined at the end of said channel adjacent to said top surface, said electrical connector comprising:

an elongated electrically conductive thin member having at a first end thereof means adapted to connect with an electrical connector, said thin member further including:

a) a shoulder adjacent said first end, b) an integral tab positioned between said shoulder and the other end of said thin member, said tab extending at an angle to said thin member and having an end, and c) a fuse blade contact portion extending from said other end of said thin member toward said first end thereof;

said thin member being adapted to be removably attached to said fuse body with:

(i) said fuse blade contact portion being in abutting contact with said one of said blades of said fuse body, (ii) said end of said tab being positioned in said channel of said fuse body and abutting said shoulder means of said channel, and (iii) said shoulder of said thin member abutting said top surface of said fuse body head portion, whereby said elongated thin member may be removably attached to said fuse body and contact blade thereof, as aforesaid, to comprise a subassembly and thereafter inserted into one of said recesses of said fuse holding block with said fuse contact blade and abutted fuse blade contact portion of said thin member being resiliently held in electrical contact with said fuse block fuse blade contact means.

2. Apparatus of claim 1 further characterized by said shoulder of said thin member resiliently abutting said top surface of said fuse body head portion.

3. Apparatus of claim 1 further characterized by said thin member having at said first end thereof male connector means adapted to connect with female connector means.

4. Apparatus of claim 1 further characterized by said other end of said thin member having a transverse width sized to substantially match the transverse width of said fuse body contact blade.

5. Apparatus of claim 1 further characterized by said thin member being thicker at said first end thereof as compared to the thickness of said member at said other end thereof.

6. Apparatus of claim 5 further characterized by said thin member being tapered in thickness from said first end thereof to said other end thereof.

7. Apparatus of claim 5 further characterized by said thin member being tapered along at least a portion of said fuse blade contact portion.

8. Apparatus of claim 1 further characterized by said thin member further including, at said other end thereof, an integral hook-like extension.

9. Apparatus of claim 8 further characterized by said extension being at an angle to the immediately adjacent said other end of said thin member.

10. Apparatus of claim 9 further characterized by said extension having a preselected length so that, when said thin member is assembled with said fuse body and contact blade thereof, as aforesaid, said extension overlies the end of said contact blade.

* * * * *